US007765999B1

(12) United States Patent
Stephens et al.

(10) Patent No.: US 7,765,999 B1
(45) Date of Patent: Aug. 3, 2010

(54) PAINTBALL MARKER WITH CONVERTIBLE MECHANICAL AND ELECTRONIC CARTRIDGES

(75) Inventors: Aaron A. Stephens, Des Plaines, IL (US); Yin Bun Bernard Luk, Kornhill (HK); Hin Wong, Tuen Mun (HK)

(73) Assignee: KEE Action Sports II LLC, New York, NY (US)

( * ) Notice: Subject to any disclaimer, the term of this patent is extended or adjusted under 35 U.S.C. 154(b) by 991 days.

(21) Appl. No.: 11/305,066

(22) Filed: Dec. 16, 2005

(51) Int. Cl.
*F41B 11/00* (2006.01)
*F41C 23/10* (2006.01)
*F41A 19/00* (2006.01)

(52) U.S. Cl. ..... 124/73; 42/71.02; 89/1.42; 89/28.1

(58) Field of Classification Search ..... 42/71.02, 42/72, 75.03; 89/1.42, 135, 28.05, 28.1; 124/73, 77
See application file for complete search history.

(56) References Cited

U.S. PATENT DOCUMENTS

| | | | | |
|---|---|---|---|---|
| 2,517,333 | A * | 8/1950 | Motley | 89/1.803 |
| 2,780,882 | A * | 2/1957 | Temple | 42/84 |
| 2,931,039 | A * | 4/1960 | Marsh et al. | 227/11 |
| 3,650,174 | A * | 3/1972 | Nelsen | 89/28.05 |
| 4,362,145 | A * | 12/1982 | Stelcher | 124/32 |
| 4,727,670 | A * | 3/1988 | Krouse | 42/69.01 |
| 5,272,828 | A * | 12/1993 | Petrick et al. | 42/84 |
| 5,901,488 | A * | 5/1999 | Oberlin | 42/84 |
| 6,003,547 | A | 12/1999 | Tippmann, Jr. | |
| 6,360,470 | B1 * | 3/2002 | Constant et al. | 42/84 |
| 6,523,534 | B2 * | 2/2003 | Juan | 124/32 |
| 6,626,165 | B1 * | 9/2003 | Bhogal | 124/77 |
| 6,763,822 | B1 * | 7/2004 | Styles | 124/77 |
| 6,766,795 | B1 | 7/2004 | Sullivan | |
| 6,772,746 | B2 | 8/2004 | Gabrel | |
| 6,889,682 | B2 * | 5/2005 | Styles et al. | 124/77 |
| 6,976,416 | B2 * | 12/2005 | Ealovega | 89/141 |
| 7,076,906 | B2 * | 7/2006 | Monks et al. | 42/84 |
| 7,197,843 | B2 * | 4/2007 | Oertwig | 42/51 |
| 2005/0121014 | A1 * | 6/2005 | Monks et al. | 124/32 |
| 2005/0257676 | A1 * | 11/2005 | Ealovega | 89/28.1 |
| 2006/0169268 | A1 * | 8/2006 | Tippmann, Jr. | 124/80 |

OTHER PUBLICATIONS

Centerflag Paintball Products, HyperFrame Electronic Trigger Manual, http://www.clicktoconvert.com.

Bill Mills, Electronic Basics for Airsmiths, WARPIG—World And Regional Paintball Information Guide, http://www.warpig.com/paintball/technical/electronics/basic_electronics/index.shtml.

(Continued)

*Primary Examiner*—Bret Hayes
(74) *Attorney, Agent, or Firm*—Neal, Gerber & Eisenberg LLP

(57) ABSTRACT

An apparatus for firing a projectile, such as a paintball, that comprises a trigger frame assembly that is detachable from either a mechanical cartridge or an electronic cartridge. The trigger frame assembly includes a trigger, a sear, and a frame on which the trigger and the sear are mounted. The trigger has a mechanical actuating surface and an electronic actuating surface. Both the mechanical cartridge and the electronic cartridge are configured to selectively attach to and detach from the frame. It is an aspect of the invention to allow a user to selectively and readily convert the apparatus between mechanical firing actuation and electronic firing actuation.

10 Claims, 10 Drawing Sheets

OTHER PUBLICATIONS

Billy Goodman, How Modern Tippman Valves Work, http://www.pukindogspaintball.com/blbk/TPV.htm.
Billy Goodman, Two-Tube Blow-Back Basics, Blow-Back Basics, http://www.pukindongspaintball.com/blbk/BB-BASICS.htm.
How The Spyder Works, Otter SC Cutoms Modifications and F.A.Q., How A Spyder Works, http://www.ottersccustoms.com/works.html.
Pearce Grip, Show Your Colors, Paintball Gun Grips, http://www.pearcegrip.com/paintball_home.htm.
Tippmann A-5 Response Trigger Kit, Rebel Ridge Paintball Equipment Sales—Paintball Markers/Guns, http://www.rebelhome.net/tippmann9.html.
Systems E-Grip, Addicted to Paintball, Tippmann A5 E-Grip System, http://www.addictedtopaintball.com/egrip/.
Tippmann Sports LLC, A-5 Shown Field Stripped, http://www.tipmann.com/markers/a5.asp.
Isaac Kennen, Tippmann Accessory, Tippmann Response Trigger System, http://paintball.about.com/cs/gear/a/responsetrigger_p.htm.
Tippmann Pneumatics, Inc., A-5 Electric Trigger Kit Installation & Tuning Instructions, www.tippmann.com.
Dye Sticky 3 Grips Photo—pbreview.com, http://www.pbreview.com/productpics/?action=browse&product=1471.
Kingman Spyder ESP Rocking Trigger Frame, Paintball Guns, Equipment and Reviews—Kingman Spyder ESP Rocking Trigger Frame, http://www.anythingxtreme.com/Kingman-Spyder-ESP-Rocking-trigger-Frame-P7277C1065.aspx.
Dye Sticky Grip, Sticky Grip: Paintball In 5, http://www.pbn5.com/paintball/paintball.mvc/p=1002535.
Extreme Rage Gel Grip w/Timer, http:www.splatdogs.net/exragelgrw.html.
Tippmann A5 E-Grip, http://www.splatdogs.net/tia5e.html.
32 Degrees Gel Grips, 32 Degrees Gel Grips Review/Reviews—pbreview.com, http://www.pbreview.com/products/reviews/1029/.

* cited by examiner

PAINTBALL MARKER WITH CONVERTIBLE MECHANICAL AND ELECTRONIC CARTRIDGES

FIELD OF THE INVENTION

The present invention relates to an apparatus for firing a projectile, such as paintball markers, used in the sport of paintball.

BACKGROUND OF THE INVENTION

Paintball "markers" or "guns" are used in the sport of paintball to mark a player's opponent with paint. Paintball markers typically use compressed gas to fire a projectile, such as a paintball, which is comprised of a thin shell encapsulating a marking dye or paint. When the projectile hits an object, such as an opposing player or other target, the shell is designed to break, releasing the dye on the target.

Paintball markers employ several different types of engineering designs for loading and firing paintballs. For example, one well known design is referred to as a "blow-back" marker. Blow-back markers employ a bolt and a hammer mechanism in which the hammer is retained by a sear, and when the sear is tripped (by being struck and thus pivoted or partially rotated), the hammer transports the bolt into a firing position, while striking an air pressure valve at the appropriate time to release an impulse of pressurized gas to fire the paintball. As part of this sequence in a blow-back marker, some compressed air is channeled back to the front of the hammer to force the hammer back into the idled or cocked position, or in other words, the marker is configured to "blow back" the hammer. Blow-back markers are often grouped into two categories according to body-style, (1) "two tube" or "stacked", and (2) "in-line". In both styles, the hammer is linked to the bolt, but in the stacked body style, the bolt is located in a separate tube above the hammer, while in the in-line body style, the bolt and hammer are linked along the same axis. An example of a stacked body style blow-back paintball marker is described in U.S. Pat. No. 6,766,795, issued to Sullivan on Jul. 27, 2004.

When blow-back markers were first introduced, they employed an entirely mechanical linkage between the trigger and the sear. More recently, electronic trigger frames have been developed that replace at least some of this mechanical linkage with electronic components. When the trigger is pulled on an electronic trigger frame, the trigger engages an electronic switch or sensor which, in turn, through electronic circuitry, trips the sear. For example, a typical electronic trigger frame has an electronic actuation switch that feeds an on/off signal to a microprocessor. The microprocessor then activates an on/off signal to a solenoid, which draws an electric charge from a capacitor and can convert the on/off signal to a linear motion. The solenoid is configured with an armature pin to engage the sear and release the hammer, thereby initiating the firing sequence.

One advantage presented by electronic trigger frames is that the microprocessor can be programmed for various firing modes, for example, single-shot bursts, multiple-shot bursts, or continuous automatic. As a result, the user can, depending on the mode set on the electronic trigger frame, fire a single shot when the trigger is fired or it can fire other sequences of shots while pulling and holding the trigger. Another advantage of electronic trigger frames is the ability to track how many shots have been fired during a given period of time, so that players can monitor their usage of paintballs.

A drawback of present electronic trigger frames is the difficulty in converting from a mechanical trigger frame to an electronic trigger frame. Frequently, the entire paintball marker must be disassembled and multiple parts must be replaced, such as the trigger assembly, the sear, the trigger frame grip, and the air tank adapter, and then the unit must be reassembled. Another common drawback is the difficulty presented in replacing a failed power source, such as a battery, in many trigger frames. Often, the entire trigger frame must be removed and components disassembled in order to replace a battery. As a result, if a battery dies in the middle of play, the player must remove himself or herself from the game and disassemble the marker to replace the battery before resuming play.

Accordingly, there is a need for a paintball marker that permits the easy conversion between mechanical and electronic firing mechanisms. These and other advantages of the invention, as well as additional inventive features, will be apparent from the description of the invention provided herein.

BRIEF SUMMARY OF THE INVENTION

The invention provides an apparatus for firing a projectile, such as a paintball, that comprises a trigger frame assembly retained in a receiver that is detachable from and interchangeable with either a mechanical cartridge or an electronic cartridge. Both the mechanical cartridge and the electronic cartridge are configured to selectively attach to and detach from the receiver. A user can selectively convert the apparatus between a mechanical firing actuation and an electronic firing actuation. The trigger frame assembly includes a frame, a trigger, and a sear. The trigger and the sear are mounted on the frame. The trigger may include a mechanical actuating surface and an electronic actuating surface.

In a further aspect of the invention, the mechanical cartridge has a housing, which may include a recess for allowing the trigger to pivot until a mechanical actuating surface on the trigger engages a first trigger surface on the sear. The electronic cartridge has a housing, which has a blocking surface for preventing the trigger from pivoting sufficiently to engage the mechanical actuating surface on the sear. Instead, an electronic actuating surface on the trigger engages an electronic actuator on the electronic cartridge.

In a further aspect of the invention, the housing forms a cavity at least partially accessible through the distal end of the housing for removably retaining the power source in the housing. The electronic cartridge further comprises a retainer attached to the distal end of the housing. The retainer is selectively adjustable between a first position and a second position. When the retainer is in the first position, the retainer retains the power source in the housing, and when the retainer is in the second position, the retainer releases the power source allowing the power source to be removed from the housing.

In a further aspect of the invention, the electronic cartridge further comprises an electronic actuator for initiating a trigger sequence, a capacitor for storing a charge, a solenoid for converting the electronic charge into linear mechanical motion, and an armature pin for engaging the sear to fire the apparatus. The housing of the electronic cartridge retains the electronic actuator, the capacitor, the solenoid, and the armature pin in the housing even when the cartridge is detached from the frame.

In a further aspect of the invention, a trigger mechanism is provided for an apparatus for firing a projectile. The trigger mechanism comprises a receiver for housing a firing assembly, a sear pivotally mounted on the receiver. The trigger has a mechanical actuating surface and an electronic actuating surface. The sear has a first trigger surface and a second trigger surface. The sear may be pivoted by selectively engaging either the first trigger surface or the second trigger surface. The trigger mechanism may be coupled with a mechanical cartridge comprising a housing having a mating portion. The mating portion is configured to mate with the separate grip. The mating portion has a recess. When the housing is attached to the grip, the recess is adjacent to the trigger and the recess allows the trigger to pivot sufficiently to engage a sear.

Alternatively, the trigger mechanism may be coupled with an electronic cartridge comprising a housing having a mating portion configured to mate with the separate grip, and a cartridge for housing a power source.

In a further aspect of the invention, a method for converting a paintball marker comprising a receiver, a trigger, and a sear from a mechanical trigger mechanism to an electronic trigger mechanism is provided. The method comprises the steps of disengaging the mechanical cartridge from the receiver while the trigger and the sear remain housed in the receiver, and then engaging the electronic cartridge with the receiver.

DETAILED DESCRIPTION OF THE INVENTION

Figure 1:
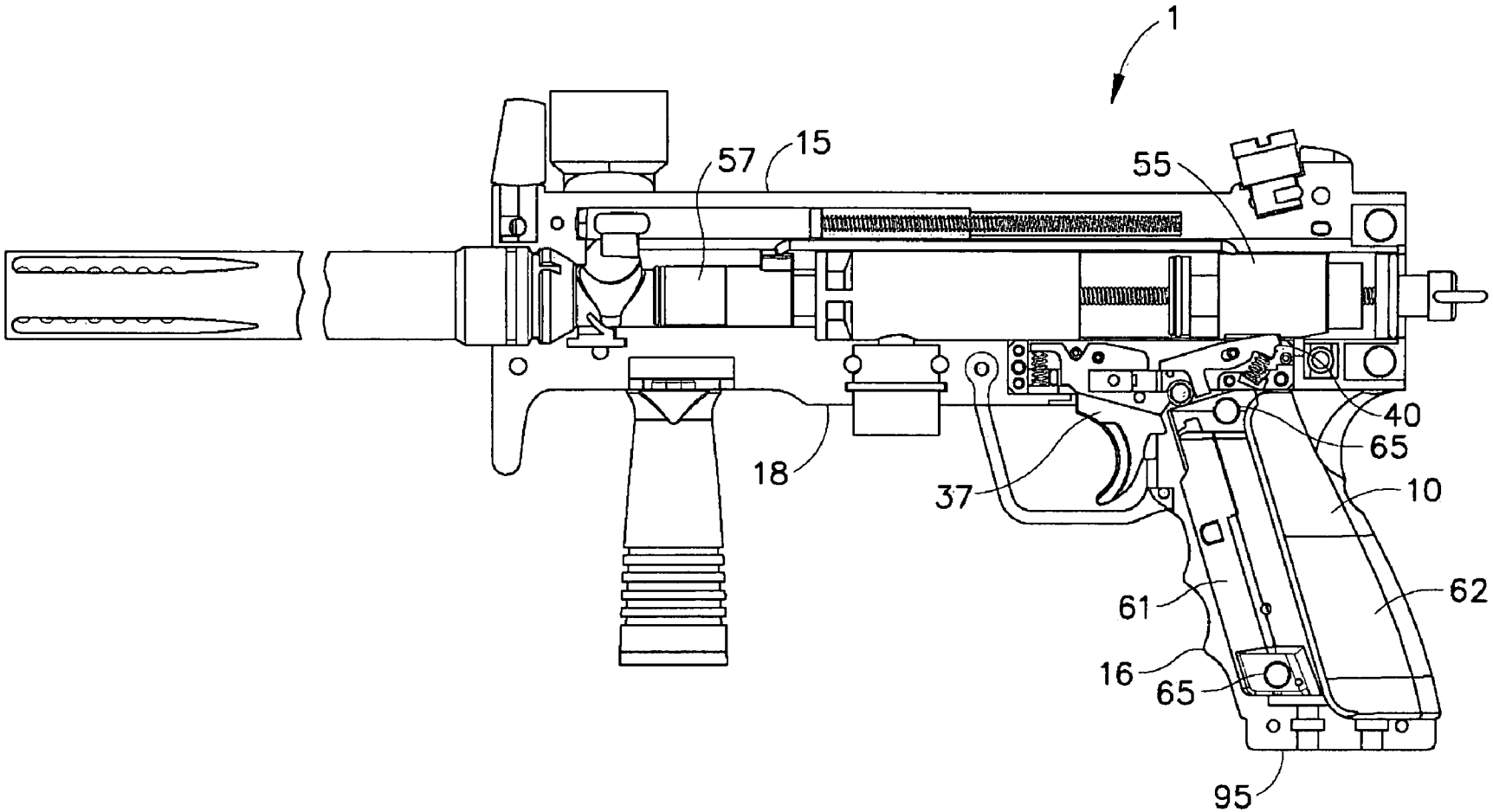
FIG. 1 illustrates a partial cut-away of an embodiment of the present invention with a mechanical cartridge.
Figure 2:
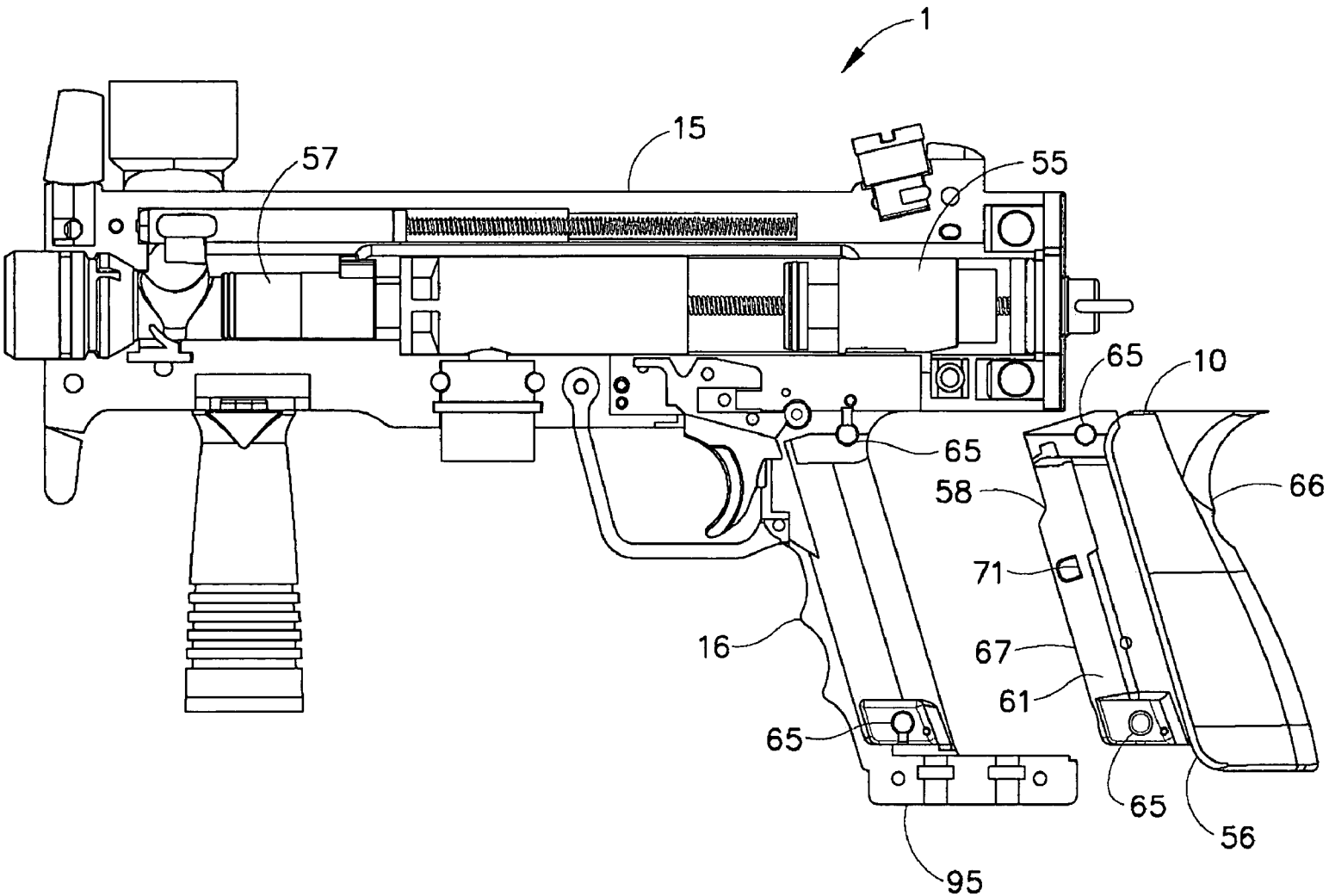
FIG. 2 illustrates a partial cut-away of the embodiment of the present invention shown in FIG. 1 with the mechanical cartridge detached.
Figure 3:
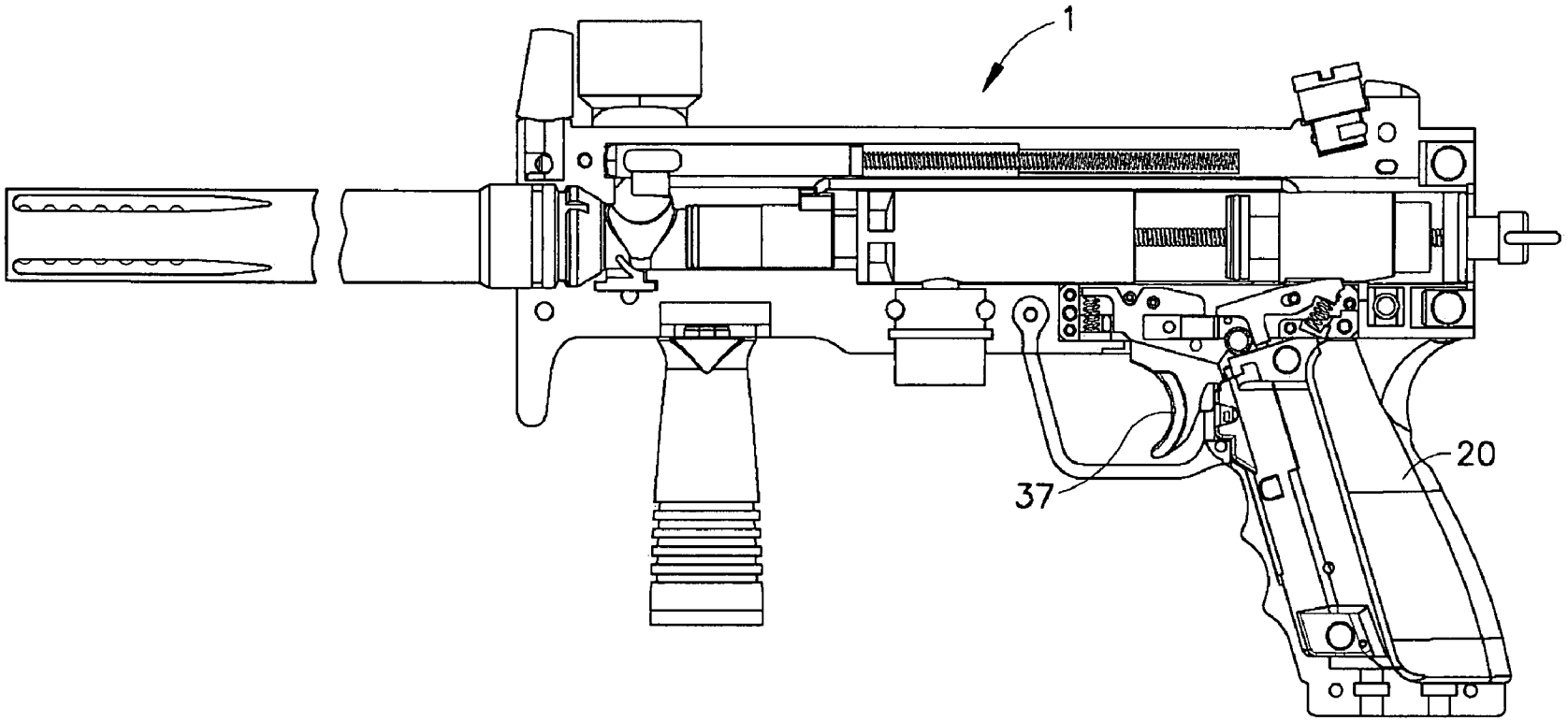
FIG. 3 illustrates a partial cut-away of an embodiment of the present invention with an electronic cartridge.

FIG. 1 depicts paintball marker 1 with detachable mechanical cartridge 10. Paintball marker 1 can be seen in FIG. 2 with mechanical cartridge 10 in a detached position. FIG. 3 depicts paintball marker 1 with detachable electronic cartridge 20. Paintball marker 1 can be seen in FIG. 4 with electronic cartridge 20 in a detached position.

Figure 5:
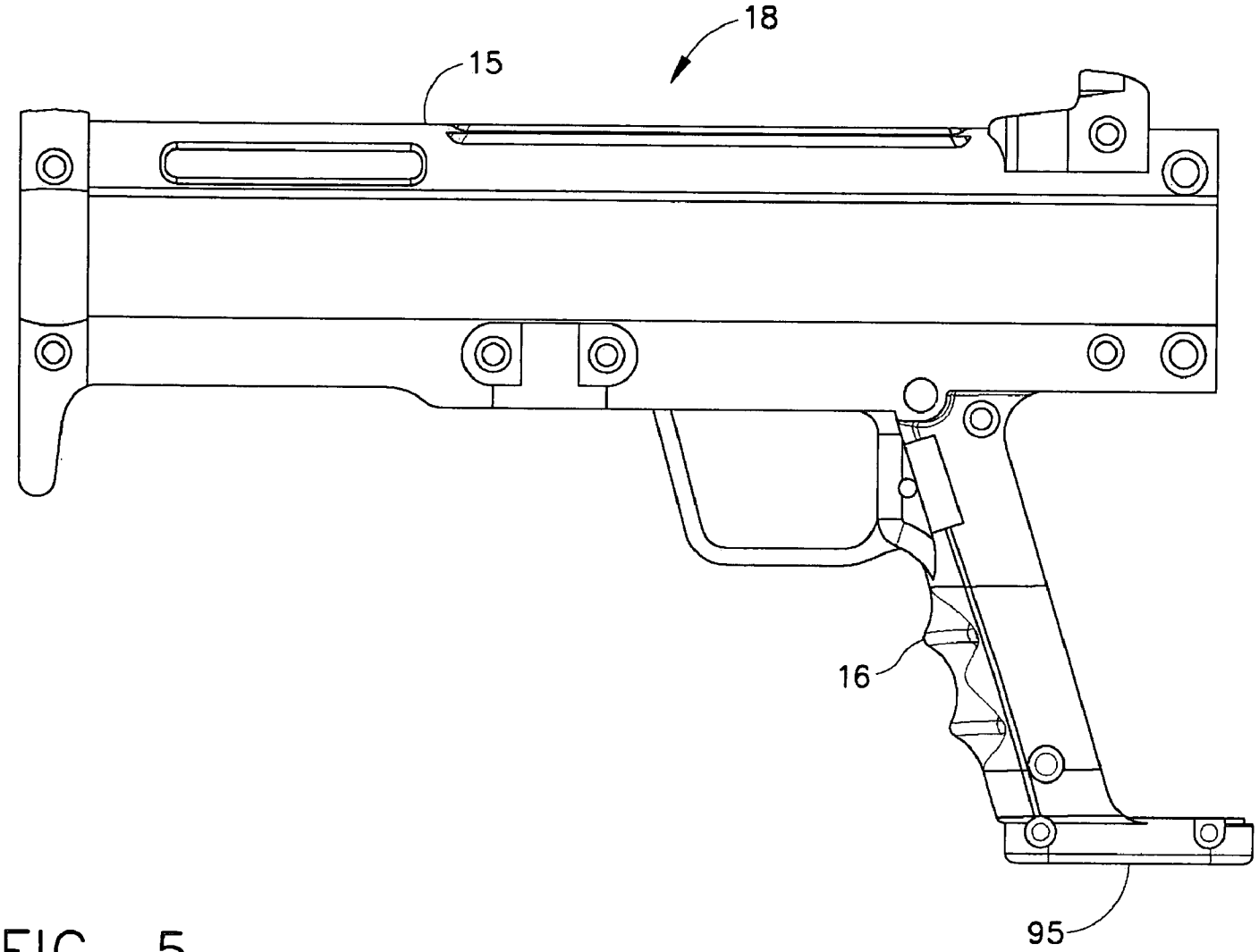
FIG. 5 illustrates a receiver housing of the present invention shown in FIG. 1.

As shown in FIG. 5, paintball marker 1 comprises receiver body 18, which integrally includes receiver 15, receiver grip 16 and air tank adapter brace 95. Receiver 15, receiver grip 16 and air tank adapter brace 95 may also be formed separately or in different combinations and assembled together to form receiver body 18, while still being separable from mechanical cartridge 10 and electronic cartridge 20. An air tank adapter (not shown) can be attached to air tank adapter brace 95.

Figure 6:
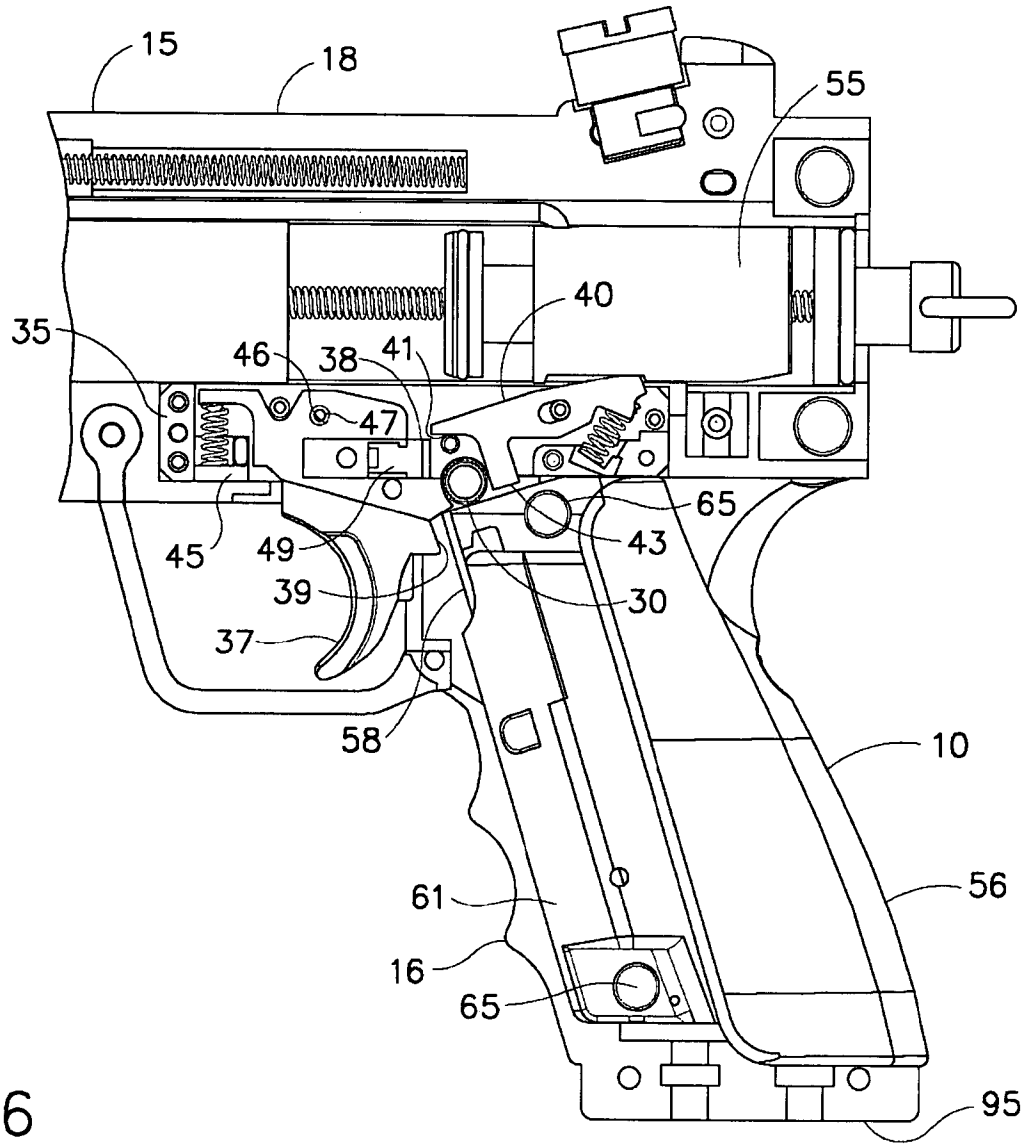
FIG. 6 illustrates a partial cut-away of the embodiment of the present invention shown in FIG. 1.

FIG. 6 shows receiver 15 retaining trigger frame assembly 35 coupled to mechanical cartridge 10. Receiver 15 houses a firing assembly, which may comprise any of hammer 55 or bolt 57.

Figure 9:
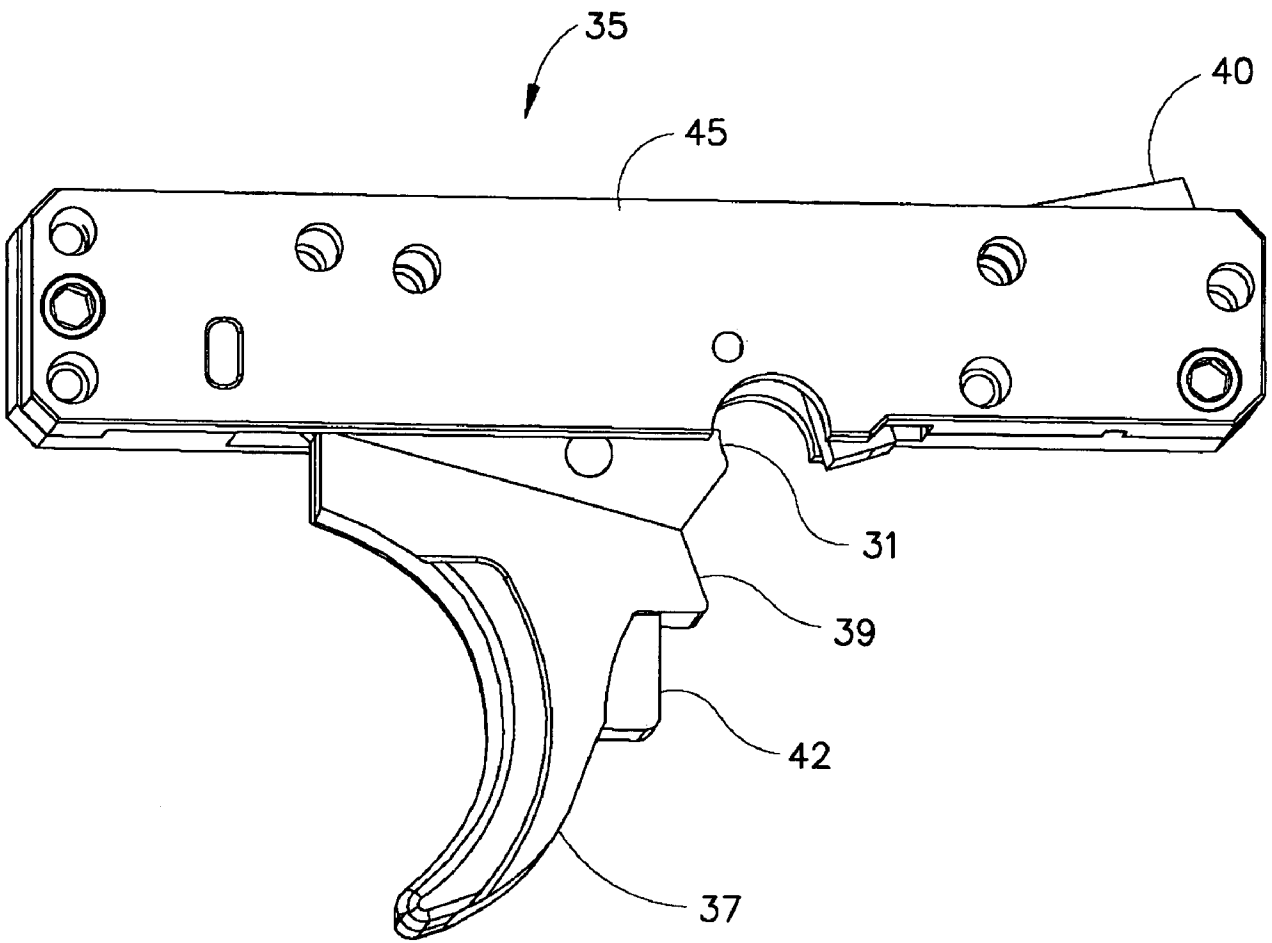
FIG. 9 illustrates a cut-away of a trigger frame of the present invention.

As shown in FIGS. 6 and 9, trigger frame assembly 35 includes trigger 37, sear 40, and frame 45. Trigger 37 and sear 40 are pivotally mounted on frame 45, which, in turn, is retained by receiver 15, but trigger 37 or sear 40 (or both) may be mounted directly on receiver 15 without departing from the present invention. As shown in FIG. 6, sear 40 has a first trigger surface 41 and second trigger surface 43. Trigger 37 has a mechanical actuating surface 38 and an electronic actuating surface 39. Trigger 37 is mounted on frame 45 through trigger aperture 46 by trigger pin 47. As seen in FIG. 6, receiver 15 is equipped with safety 30, which is slideable in receiver 15 perpendicular to plane of the rotation of sear 40. Safety 30 selectively engages trigger safety surface 31 (shown in FIG. 9) and locks trigger 37. When safety 30 is disengaged from trigger safety surface 31, trigger 37 can be pulled to fire paintball marker 1.

In the embodiment shown in FIG. 6, mechanical actuating surface 38 is provided on trigger return 49, which is slideably mounted on trigger 37. As well known in the art, trigger return 49 permits trigger 37 to return to the idle position after a firing sequence, even if trigger 37 is held in the pulled position after the firing sequence is completed. Although known in the art, a brief description of trigger return 49 (or trigger release) function follows. When trigger 37 is pulled back to fire paintball marker 1 with mechanical cartridge 10, mechanical actuating surface 38 engages sear 40 and rotates sear 40 clockwise, releasing hammer 55. If trigger 37 remains pulled by a user after a firing sequence is completed and sear 40 catches hammer 55, the spring force on hammer 55 will urge sear 40 toward trigger 37. If trigger return 49 were not provided, the trigger would be stuck in the pulled position after the sear catches the hammer. Accordingly, because trigger return 49 is slideably mounted on trigger 37, sear 40 urges trigger return 49 away from sear 40, allowing trigger 37 to release to the idle position. Once in the idle position, trigger return spring (not shown), which is compressed between trigger 37 and trigger return 49, urges trigger return 49 back to the extended position under sear 40, so that it can engage sear 40 when pulled again. Other trigger return mechanisms are known in the art including, but not limited to, providing a pivoting trigger return, rather than the illustrated slideable configuration.

Figure 10:
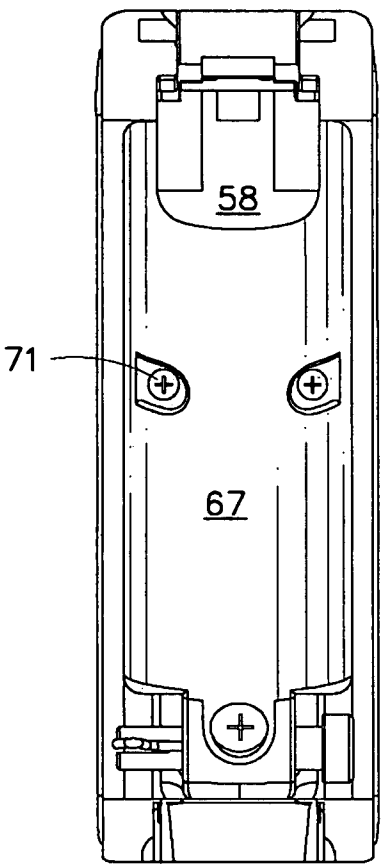
FIG. 10 illustrates a plane view of the mechanical cartridge shown in FIG. 2.

As shown in FIG. 6, mechanical cartridge 10 has a housing 56, which has a recess 58. When mechanical cartridge 10 is mated with receiver 15, recess 58 allows trigger 37 to pivot until mechanical actuating surface 38 engages first trigger surface 41 on sear 40. As shown in FIG. 2, housing 56 of mechanical cartridge 10 has a mating surface 61 to mate with receiver body 18, and in particular, with receiver grip 16. Opposite the mating surface 61, housing 56 forms grip surface 62, which, when mechanical cartridge 10 is mated with receiver grip 16 (shown in FIG. 1), creates a comfortable grip for holding paintball marker 1. As shown in FIG. 2, in one embodiment, housing 56 is constructed from two pieces, primary case 66 and functional cover 67. As shown in FIG. 10, functional cover 67 forms recess 58 and is joined to primary case 66 by fasteners 71. As shown in FIG. 2, mechanical cartridge 10 slides into receiver grip 16 until mating surface 61 mates with receiver grip 16. Locking pins (not shown) can be removably inserted in locking bores 65 (which extend through both housing 56 and receiver grip 16) to secure mechanical cartridge 10 to receiver grip 16.

Figure 7:
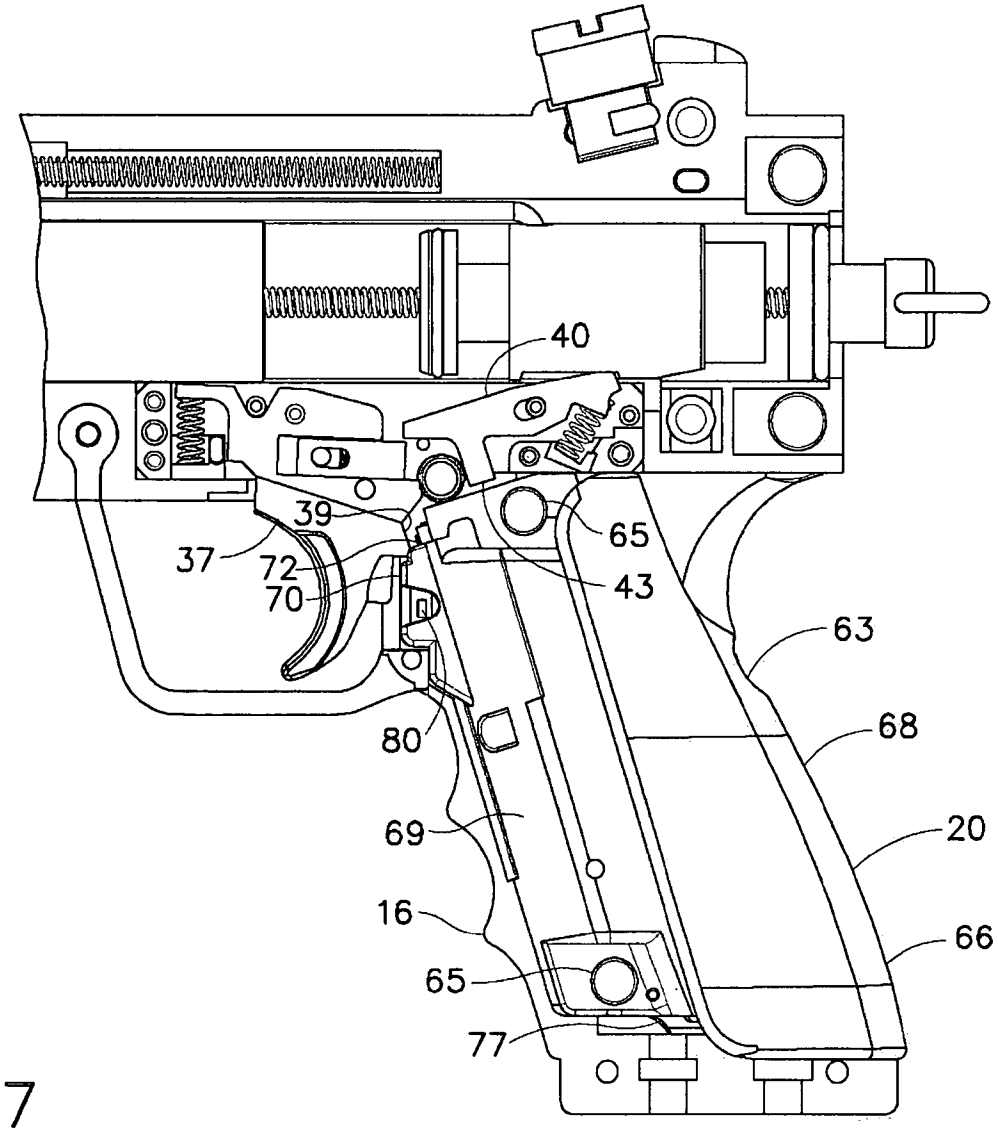
FIG. 7 illustrates a partial cut-away of the embodiment of the present invention shown in FIG. 3.
Figure 8:
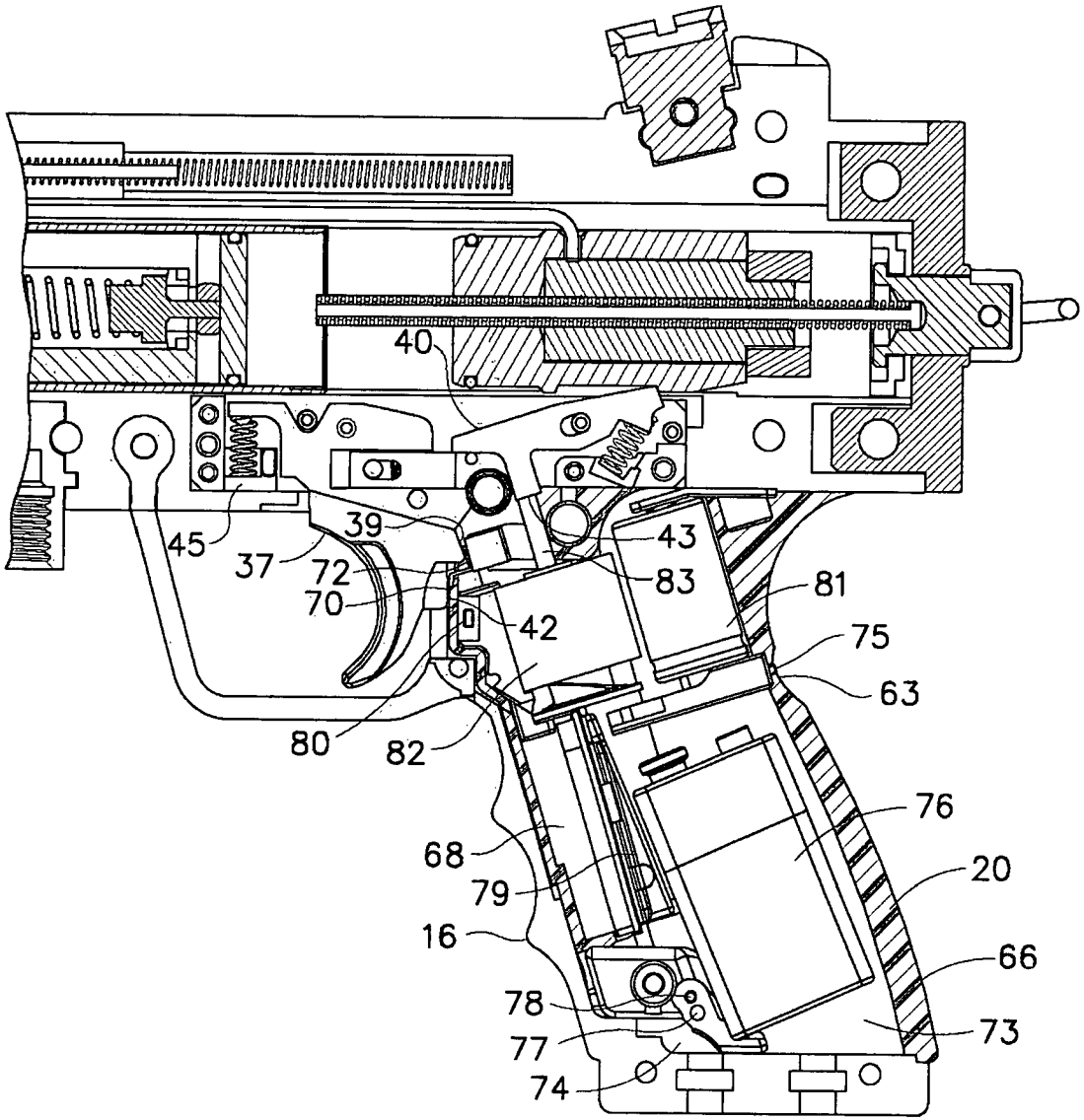
FIG. 8 illustrates a partial cut-away of the electronic cartridge of the present invention shown in FIG. 3.

FIGS. 7 and 8 show electronic cartridge 20 with housing 68. Housing 68 forms blocking surface 70. When electronic cartridge 10 is mated with receiver 15, blocking surface 70 prevents mechanical actuating surface 38 on trigger 37 from engaging sear 40 when trigger 37 is pulled. Instead, trigger blocking surface 42 mates with blocking surface 70 on electronic cartridge 10, preventing trigger 37 from further rotation. Although blocking surface 70 prevents mechanical actuating surface 38 from engaging sear 40, electronic actuating surface 39 on trigger 37 engages electronic actuator 72 on electronic cartridge 20. In one embodiment, electronic actuator 72 may be a micro switch, although other electronic actuators or sensors could be substituted by those of skill in the art without departing from the invention. Blocking surface 70 also prevents damage to electronic actuator 72.

Figure 4:
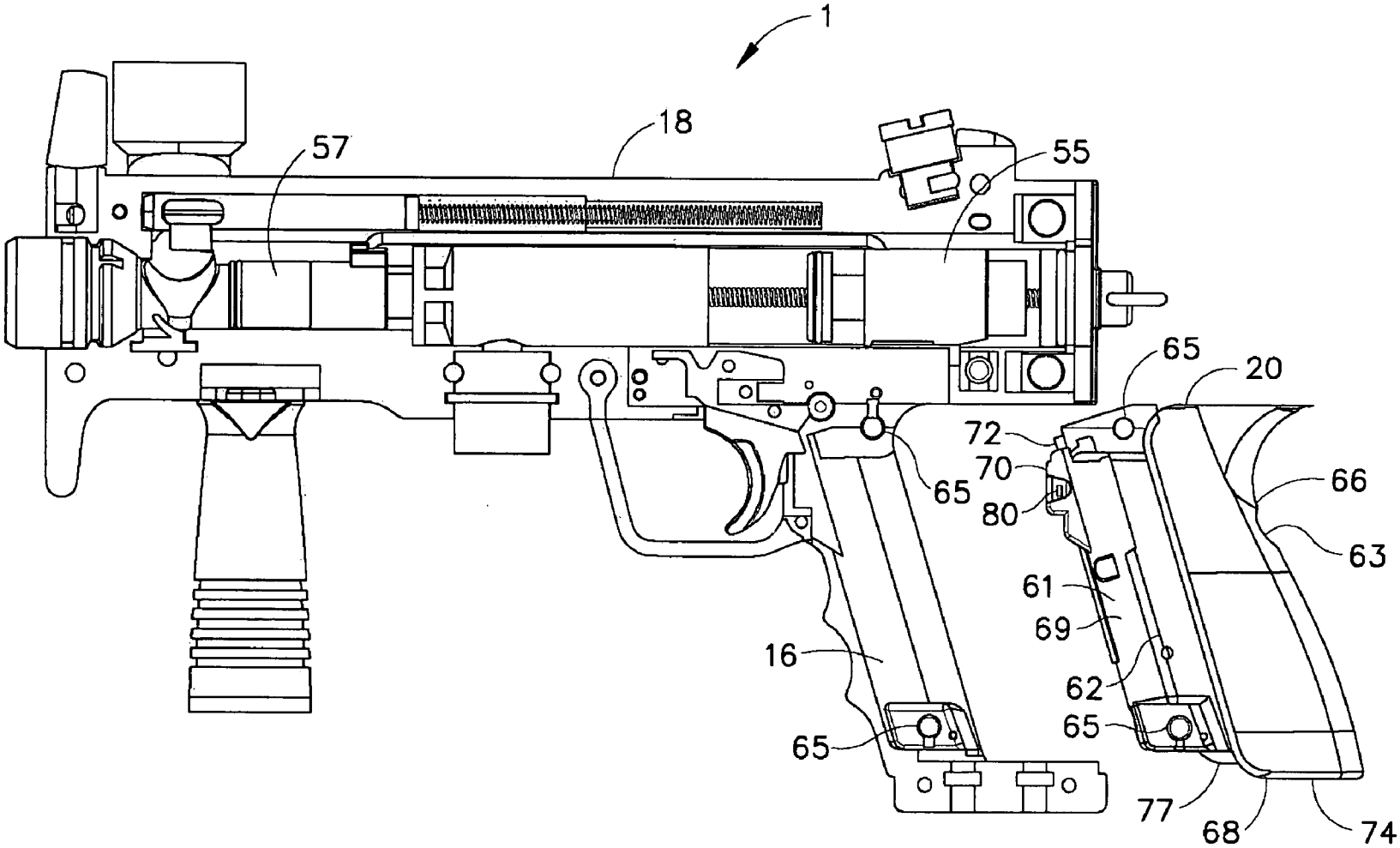
FIG. 4 illustrates a partial cut-away of the embodiment of the present invention shown in FIG. 3 with the electronic cartridge detached.
Figure 12:
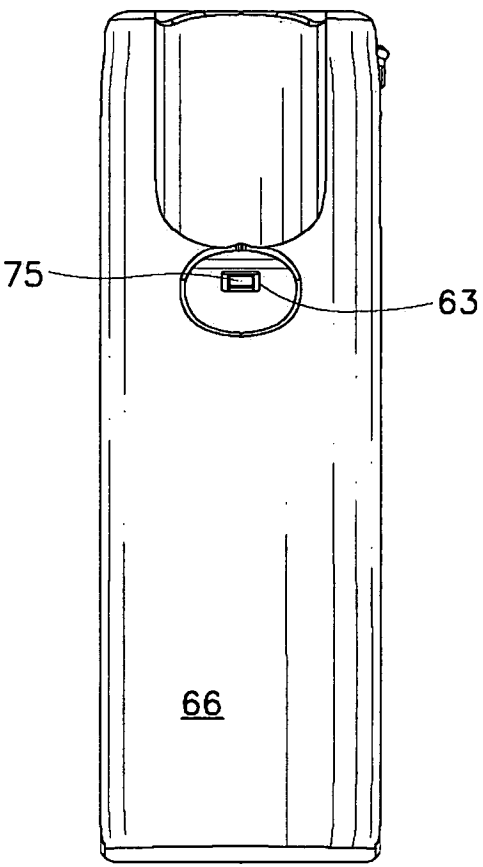
FIG. 12 illustrates the opposite plane view of the electronic cartridge shown in FIG. 11.
Figure 11:
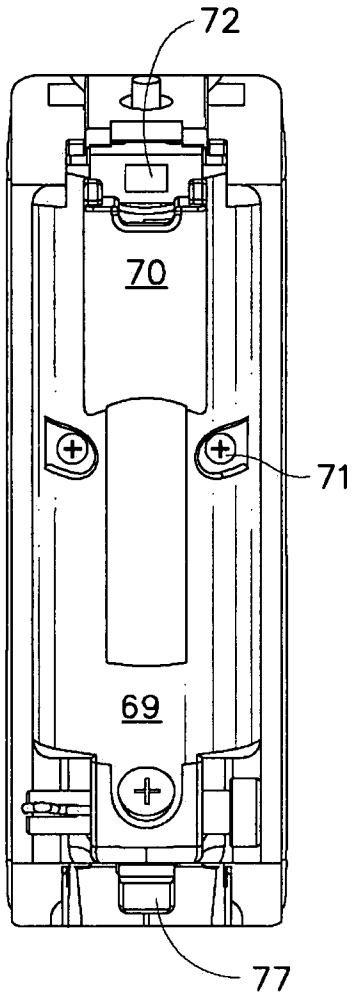
FIG. 11 illustrates a plane view of the electronic cartridge shown in FIG. 3.

As shown in FIG. 4, like mechanical cartridge 10, housing 68 of electronic cartridge 20 has a mating surface 61 to mate with receiver body 18 and, in particular, with receiver grip 16. Opposite mating surface 61, housing 68 forms grip surface 62, which, when electronic cartridge 20 is mated with receiver grip 16, creates a comfortable grip for holding paintball marker 1. As shown in FIG. 11, housing 68 is constructed from two pieces, primary case 66 and functional cover 69. As shown in FIG. 12, primary case 66 also includes bore 63, which provides access to power button 75 as shown in FIG. 8. Power button 75 protrudes through bores in the case, and the case has a recess for accessing the power button. While functional cover 69 provides blocking surface 70 and is different from functional cover 67 for mechanical cartridge 10, primary case 66 can be used with both mechanical cartridge 10 and electronic cartridge 20, thus reducing the number of parts required for manufacture.

As shown in FIG. 8, housing 68 of electronic cartridge 20 forms cavity 73 at least partially accessible through distal end 74 of housing 68. Cavity 73 removably retains power source 76. Retainer 77 is attached to distal end 74 of housing 68. In one embodiment, retainer 77 rotates on retainer pin 78 to selectively adjust between at least a first position (shown in FIG. 8) and a second position (not shown). When electronic cartridge 20 is detached from frame 45, and retainer 77 is in the first position, retainer 77 retains power source 76 in housing 68, and when retainer 77 is rotated into the second position (not shown), retainer 77 releases power source 76, allowing power source 76 to be removed from housing 68. As will be appreciated by those of skill in the art, when electronic cartridge 20 is detached, as in FIG. 4, power source 76 will remain secured in electronic cartridge 20 until a user releases retainer 77, for example, so power source 76 may be replaced.

As seen in FIG. 8, electronic cartridge 20 further includes microprocessor 79 for controlling firing sequence and timing, capacitor 81 for storing an electrical charge, and solenoid 82 for converting the electronic charge into linear motion. Solenoid 82 is linked to armature pin 83 for engaging sear 40 to fire paintball marker 1. As known by those of skill in the art, electronic actuator 72 is electrically coupled to microprocessor 79. Microprocessor 79 is electrically coupled to power source 76 and to solenoid 82. Power source 76 is also electrically coupled to capacitor 81, which stores a predetermined electrical charge. Capacitor 81 is electrically coupled to solenoid 82. Power switch 75 controls power to the entire electronic cartridge 20. As shown in FIG. 4, in one embodiment, housing 68 of electronic cartridge 20 houses electronic actuator 72, capacitor 81, solenoid 82, and armature pin 83, all retained within housing 68 when electronic cartridge 20 is detached from receiver 15.

Viewing FIG. 8, power switch 75 may be depressed to activate electronic cartridge 20. When trigger 37 is pulled with electronic cartridge 20 mated with receiver body 18, electronic actuating surface 39 on trigger 37 actuates electronic actuator 72. Upon activation of electronic actuator 72, a signal is sent to microprocessor 79, which sends an activation signal to trip solenoid 82, upon which, solenoid 82 pulls a charge from capacitor 81 and instantly thrusts armature pin 83 into sear 40, and then returns to the initial position. So upon activation of solenoid 82, armature pin 83 is urged upward engaging sear 40 on second trigger surface 43, thereby rotating sear 40 clockwise, releasing hammer 55. Those skilled in the art will appreciate that the present invention may also be practiced without a microprocessor, having electronic actuator 72 directly activate solenoid 82 instead.

In one embodiment, firing mode switch 80 is also electrically coupled to microprocessor 79. In this embodiment, microprocessor 79 is programmed to provide a selection of output signals depending on the setting input via the firing mode switch 80. As a result, the microprocessor 79 can be programmed to activate solenoid 82 (and thereby the firing sequence) in a multitude of modes. For example, in response to continuous pressure on trigger 37, and thereby continuously activating electronic actuator 72, microprocessor 79 can be programmed to activate burst fire, that is, bursts of shots, for example, a three-, four-, five-, etc. burst of shots, or to activate continuous firing, that is, fully automatic. Similarly, microprocessor 79 could control the timing of the shots.

As described above, both mechanical cartridge 10 and electronic cartridge 20 are configured to selectively attach to and detach from receiver 15. It will be evident from the description that the invention allows a user to selectively convert paintball marker 1 between mechanical firing actuation and electronic firing actuation according to the following method. The method comprises the step of disengaging mechanical cartridge 10 from receiver 15 by removing locking pins (not shown) from locking bores 65 and sliding mechanical cartridge 10 from receiver body 18. During and after the step of removing mechanical cartridge 10, trigger 37 and sear 40 remain intact within receiver 15. The next step is to engage electronic cartridge 20 with receiver 15 by sliding electronic cartridge 20 into receiver body 18. Electronic cartridge 20 can be exchanged back again with mechanical cartridge 10 by reversing the previous steps. In addition, electronic cartridge 20 and mechanical cartridge 10 can be repeatedly exchanged without removing air tank adapter brace 95 from receiver body 18 or receiver 15, and without removing the air tank adapter (not shown) from receiver grip 16 or from air tank adapter brace 95.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for firing a projectile, the apparatus comprising:

a receiver for housing a firing assembly;

a trigger pivotally retained by the receiver, the trigger having a mechanical actuating surface and an electronic actuating surface; and a cartridge removably and externally attached to the receiver, the cartridge comprising one of either a mechanical cartridge having a recess for permitting mechanical activation of the firing assembly or an electronic cartridge having a blocking surface for preventing mechanical activation of the firing assembly.

2. The apparatus of claim 1, further comprising fasteners for selectively securing either the mechanical cartridge or the electronic cartridge to the receiver.

3. The apparatus of claim 1, wherein a sear is pivotally retained by the receiver, the sear having a first trigger surface and second trigger surface, whereby the sear may be pivoted relative to the receiver by selectively engaging either the first trigger surface or the second trigger surface.

4. The apparatus of claim 3, wherein when the mechanical cartridge is attached to the receiver, the recess allows the mechanical actuating surface to engage the first trigger surface.

5. The apparatus of claim 3, wherein when the electronic cartridge is attached to the receiver, the blocking surface prevents the trigger from pivoting sufficiently for the mechanical actuating surface to engage the first trigger surface.

6. The apparatus of claim 1, wherein the electronic cartridge has an electronic actuator, whereby when the electronic cartridge is attached to the receiver and the trigger is pivoted, the electronic actuating surface engages the electronic actuator.

7. The apparatus of claim 6, wherein engaging the electronic actuator causes an armature pin to engage the second trigger surface.

8. The apparatus of claim 1, wherein the electronic cartridge comprises a housing that forms a cavity at least partially accessible through a distal end of the housing for removably housing a power source.

9. The apparatus of claim 8, wherein the cartridge further comprises a retainer attached to the distal end of the housing, the retainer being selectively adjustable between at least a first position and a second position, whereby when the retainer is in the first position, the retainer retains the power source in the housing, and when the retainer is in the second position, the retainer releases the power source allowing the power source to be removed from the housing.

10. The apparatus of claim 9, wherein the cartridge further comprises:

an electronic actuator for initiating a trigger sequence;

a capacitor for storing a charge;

a solenoid; and an armature pin for engaging a sear to fire the apparatus, wherein the housing retains the electronic actuator, the capacitor, the solenoid, and the armature pin when the cartridge is detached from the receiver.

* * * * *